US006209292B1

(12) United States Patent
Krahn

(10) Patent No.: US 6,209,292 B1
(45) Date of Patent: Apr. 3, 2001

(54) DEBIT CARD BOX PACKAGE

(75) Inventor: Gerald C. Krahn, Vancouver, WA (US)

(73) Assignee: Moore North America, Inc., Grand Island, NY (US)

( * ) Notice: Subject to any disclaimer, the term of this patent is extended or adjusted under 35 U.S.C. 154(b) by 0 days.

(21) Appl. No.: 09/578,850

(22) Filed: May 26, 2000

Related U.S. Application Data

(62) Division of application No. 09/338,523, filed on Jun. 23, 1999, now Pat. No. 6,145,665.

(51) Int. Cl.[7] ..... B65B 5/02; B65B 11/48
(52) U.S. Cl. ..... 53/458; 53/461
(58) Field of Search ..... 206/232, 756, 206/775, 776, 806; 53/458, 461

(56) References Cited

U.S. PATENT DOCUMENTS

| | | | | |
|---|---|---|---|---|
| 856,853 | * | 6/1907 | Eckstein | 53/458 |
| 1,228,714 | | 6/1917 | Sturtz . | |
| 1,787,569 | | 1/1931 | Deutschmeister . | |
| 3,029,711 | * | 4/1962 | Griese | 53/458 |
| 3,791,572 | * | 2/1974 | Gendron | 206/232 |
| 3,946,870 | * | 3/1976 | Gajer et al. | 206/775 |
| 5,433,316 | | 7/1995 | McQueeny . | |
| 5,609,253 | | 3/1997 | Goade, Sr. . | |
| 5,650,209 | | 7/1997 | Ramsburg et al. . | |
| 5,667,247 | | 9/1997 | Ramsburg et al. . | |
| 5,760,381 | | 6/1998 | Stich et al. . | |
| 5,791,474 | | 8/1998 | Hansen . | |
| 5,842,629 | | 12/1998 | Sprague et al. . | |
| 5,984,091 | * | 11/1999 | Orr et al. | 206/232 |

* cited by examiner

*Primary Examiner*—John Sipos
(74) *Attorney, Agent, or Firm*—Nixon & Vanderhye PC

(57) ABSTRACT

A method of packaging and displaying a relative flat product, and intermediate and final package produced, allow a desirably thick package to be produced yet the package can be shipped in a low volume configuration to save shipping costs, and can be expanded at or adjacent the display site in a simple yet effective manner. The package is particularly suitable for packaging a prepaid phone card having machine readable indicia, an opening being provided in the package blank so that the machine readable indicia is visible through the opening so that the phone card can be activated without removing the phone card from the completed package.

18 Claims, 5 Drawing Sheets

DEBIT CARD BOX PACKAGE

This appln is a div of Ser. No. 09/338,523 filed Jun. 23, 1999, U.S. Pat. No. 6,145,665.

BACKGROUND AND SUMMARY OF THE INVENTION

Typically, when relatively flat articles for sale are packaged, such as prepaid phone cards, they are displayed in relatively flat packages. For example, conventional packages that allow successful display of prepaid phone cards or the like, are shown in U.S. Pat. Nos. 5,760,381, 5,791,474 and 5,842,629 (the disclosures of which are hereby incorporated by reference herein). Such displays allow a card to be displayed in a relatively large package, yet allow the card to be activated without separating the card from the package.

While the packages described in the above mentioned patents are successful in performing many of the desired functions, for some retail establishments they do not have the appropriate perceived value, nor do they properly occupy retail display areas in the manner that many retailers desire. While for some product those problems may be remedied by utilizing a conventional plastic clamshell package, such clamshell packages are expensive to ship because of their inherent volume, the per piece cost of shipping being much higher than for products such as in the aforementioned patents.

According to the present invention a method of packaging and displaying a relatively flat article, and an intermediate package, and a completed packaging containing such an article, are provided which have the advantages of both conventional relatively large and thick packages like clamshell packages, and relatively flat packages such as in the aforementioned patents. The present invention provides an intermediate package that may be shipped in a low volume configuration, and then quickly and easily expanded at or near the display location so that it has significant thickness. For example, according to the invention the final package produced may easily be made ¾ inch thick so that when it is displayed on J-hooks, or like hooks in retail establishments, a hook does not look empty even if there is only one package hanging on it, and a very aesthetic display is provided. Also because of the bulk of the package it is not easy to shoplift, yet it can be opened and closed (typically without the relatively flat article being packaged being readily removable therefrom) without destroying the package, and it is essentially as inexpensive to ship as the substantially flat packages shown in the aforementioned patents.

According to one aspect of the present invention a method of packaging and displaying a relatively flat article is provided comprising: (a) Cutting a box blank from a sheet or web of paperboard, the blank having first and second major surfaces. (b) Attaching the relatively flat article to the first major surface of the blank. (c) Folding the blank around the relatively flat article, and attaching portions of the blank to each other, to form an intermediate package and so that the first major surface is at least primarily an inner surface of the intermediate package, and so that the second major surface is at least primarily an outer surface of the intermediate package, and so that the intermediate package is also substantially flat, having a first interior volume. Then (d) shipping the substantially flat intermediate package to at or near a display location. Then (e) at or near the display location, expanding the substantially flat intermediate package so that it has a second interior volume greater than the first interior volume, to form a completed package. (f) Acting on the completed package to maintain it in completed package form. And then (g) displaying the completed package from (f) at the display location.

According to one aspect of the invention the substantially flat article is a prepaid phone card having machine readable activation indicia thereon; and the method further comprises, prior to (c), cutting an opening in the blank; and wherein (c) is practiced by affixing the phone card to the blank so that the machine readable activation indicia is visible through the opening in the blank so that the phone card can be activated without removing the phone card from the completed package. Typically (a)–(e) are practiced so that the second volume is at least three times the first volume, and the completed package is at least about 0.7 inches thick.

In the method preferably (b) is practiced using removable adhesive acting substantially directly between the article and the blank first surface. Also, preferably (c) is practiced in part by affixing portions of the blank first surface to portions of the second surface using permanent adhesive. Desirably (a) and (c) are practiced so as to provide end closing flaps for the completed package; and (f) is practiced to move the end closing flaps into position so as to close the completed package and maintain the completed package in expanded condition; and typically (a) and (c) are further practiced to provide an interior support web moveable between non-supporting and supporting positions. Also, (f) is preferably further practiced to move the support web to its supporting position. For example, (b) and (c) may be further practiced so that the support web at least assists in holding the article in position within the intermediate package.

In the practice of the invention typically the intermediate package has opposite closed side edges, and opposite open ends; and (e) is practiced to squeeze the closed side edges toward each other. For example, (f) is practiced to close the opposite open ends; and (a)–(g) are practiced using a prepaid phone card, debit card, substantially flat pharmacy product, gift certificate, pad of specialty paper, inflatable primarily elastomeric element, electronic remote control, or printed publication, as the article being packaged.

The method may further comprise (h) printing the blank so that the second surface thereof has indicia thereon; and (i) forming one or more display hook-receiving openings in the blank; and (g) may be practiced by passing a display hook through the one or more hook-receiving openings. For example, the method may comprise forming one or more display hook-receiving openings in the blank; and (g) may be practiced by passing a display hook through the one or more hook-receiving openings.

According to another aspect of the present invention an intermediate package is provided comprising: A substantially flat article. A box blank comprising a sheet of paperboard, and having first and second major surfaces. The relatively flat product affixed to the first major surface of the blank. The blank folded around the relatively flat product, and portions of the blank affixed to each other, to form an intermediate package and so that the first major surface is at least primarily an inner surface of the intermediate package, and so that the second major surface is at least primarily an outer surface of the intermediate package, and so that the intermediate package is also substantially flat, having a first interior volume. And the substantially flat intermediate package expandable so that it has a second interior volume at least about three times as great as the first interior volume, to form a completed package.

In the intermediate package, typically the blank further comprises an interior support web moveable between non-supporting and supporting positions, and movable into its supporting position only when the intermediate package is expanded into a completed package form. For example, the support web at least assists in holding the article in position within the intermediate package. Typically, the intermediate package has opposite closed side edges, and opposite open ends, and the closed side edges may be squeezed toward each other to expand the intermediate package first volume to the second volume. Some examples of the article to be packaged comprise at least one of a prepaid phone card, debit card, substantially flat pharmacy product, gift certificate, pad of specialty paper, inflatable primarily elastomeric element, electronic remote control, or printed publication, but other suitable articles may also be practiced. Typically, the blank further comprises end closing flaps which are movable to hold the package in the second interior volume position. The package also typically comprises one or more display hook-receiving openings in the blank, and the second major surface of the blank may be printed with indicia.

The article package may comprise an article comprises an article with a machine readable indicia on a portion thereof, and an opening in the blank, the article positioned so that the machine readable indicia is positioned at and machine readable through the opening.

The completed package packaging a substantially flat article and mounted in a display is typically constructed and displayed by practicing a method as described above.

According to yet another aspect of the present invention a package blank is provided comprising a cutout paperboard sheet and including: A first major portion having a free side edge and a second side edge integral with a first completed package side portion; a second major portion being a first side edge integral with the first completed package side portion and a second side edge integral with a second completed package side portion; first and second support web base portions and a support web support portion for supporting an intermediate part of the first and second major portions, the first base portion integral at one side thereof with the second completed package side portion and at the other side thereof with the web support potion, and the second web base portion integral at one side thereof with the web support portion and the second side thereof being free. Closing end flaps formed on at least one of the first and second major portions. And a substantially rectangular cutout formed in at least one of the first and second major portions. The blank may further comprise a display hook mounting flap formed on one of said first card second major portions and having at least one hook securing opening therein.

It is the primary object of the present invention to provide for the inexpensive shipping, yet bulkiness at display, of relatively flat articles. This and other objects of the invention will become clear from a detailed description of the invention, and from the appended claims.

DETAILED DESCRIPTION OF THE DRAWINGS

Figure 1:
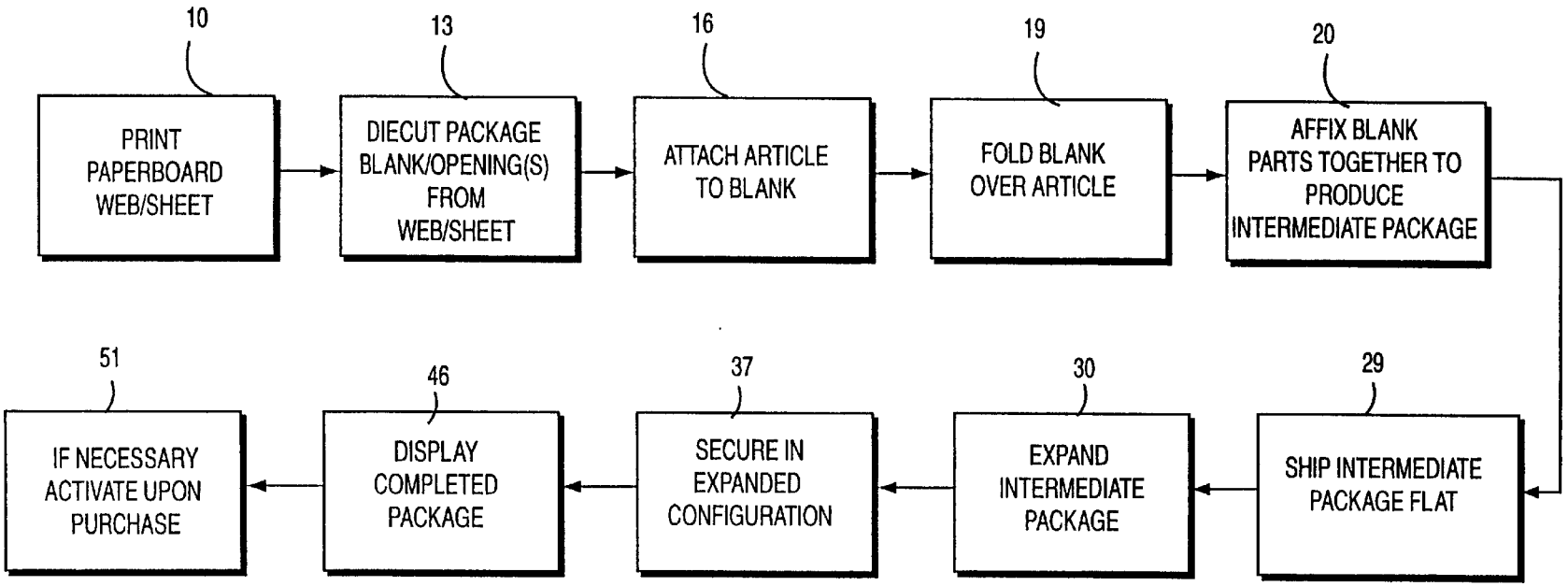
FIG. 1 is a box diagram showing exemplary method procedures that may be practiced pursuant to an exemplary method according to the present invention.

FIG. 1 very schematically illustrates the exemplary method procedures that may be practiced pursuant to the present invention. The invention is described with respect to the printing and handling of paperboard in either web of sheet form. However, it should be understood that the term "paperboard" as used herein is used in its broadest sense to include products which are conventionally known as paperboard, cardboard, or card stock, as long as they have sufficient weight to effectuate the objectives of the invention, while not being so bulky as to be impractical in effecting the objects of the invention.

The first procedure illustrated in FIG. 1, by box 10, is to print a paperboard web or sheet with indicia, such as with the indicia 11 illustrated in FIGS. 3 and 5, and which can include package bar coding such as illustrated at 12 in FIG. 5, although the bar coding 12 may be subsequently applied by a label, or may be variably printed at some later stage. As illustrated schematically at 13 in FIG. 1, a package blank—such as illustrated generally by reference numeral 14 in FIG. 2—is die cut, or otherwise formed, from the paperboard web or sheet, and where necessary one or more openings, such as the opening 15 illustrated in FIG. 2, may be die cut or otherwise formed in the web or sheet, or in the package blank. The die cutting of the blank 14 and the opening 15 preferably are done at approximately the same time, although they may be done in any order, and the printing stage 10 may be after, or between, the die cutting stages (although preferably the stage 10 is before the stage 13).

Typically after the blank 14 is formed, and if one or more openings 15 are provided after the one or more openings are die cut, as indicated schematically at stage 6 in FIG. 1, the article to be packaged is attached to the blank 14. This may be accomplished by any conventional mechanism, such as staples, stickers, labels, tabs formed from the paperboard of the blank 14, or using a wide variety of conventional adhesives. For example, for the embodiment illustrated in FIG. 2, where a plastic card shown in dotted line by reference numeral 17 is to be affixed adjacent the opening 15, conventional removable shapes or patterns of hot melt glue, shown generally by reference numeral 18, are provided acting between the paperboard of the blank 14 and the card 17 to hold the card 17 in place. Note that under some circumstances the attaching stage 16 may be practiced before the stages 13 and/or 10, although desirably these stages are practiced in the sequence in FIG. 1.

Figure 2:
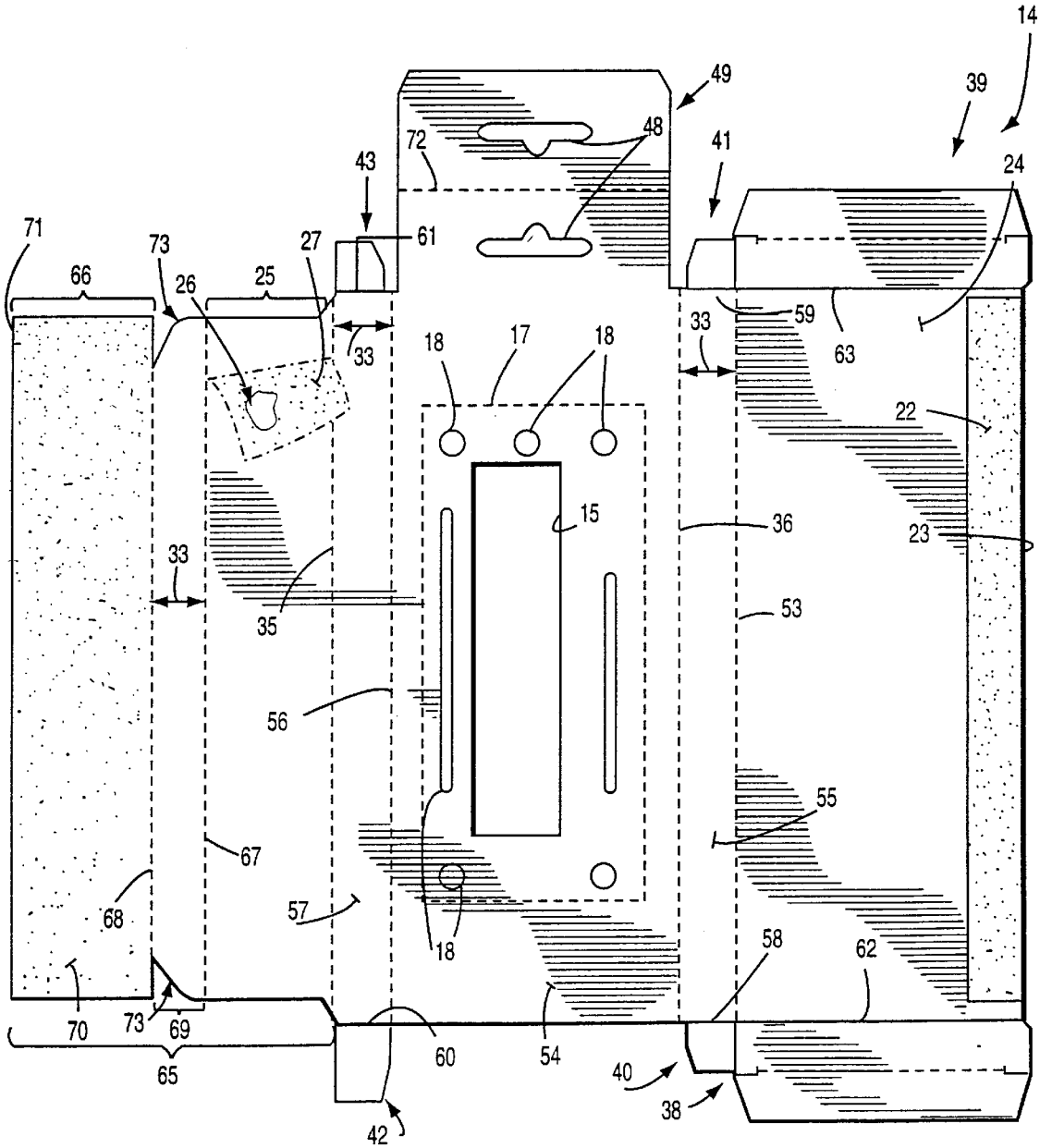
FIG. 2 is a bottom plan view of one embodiment of an exemplary package blank according to the present invention.
Figure 3:
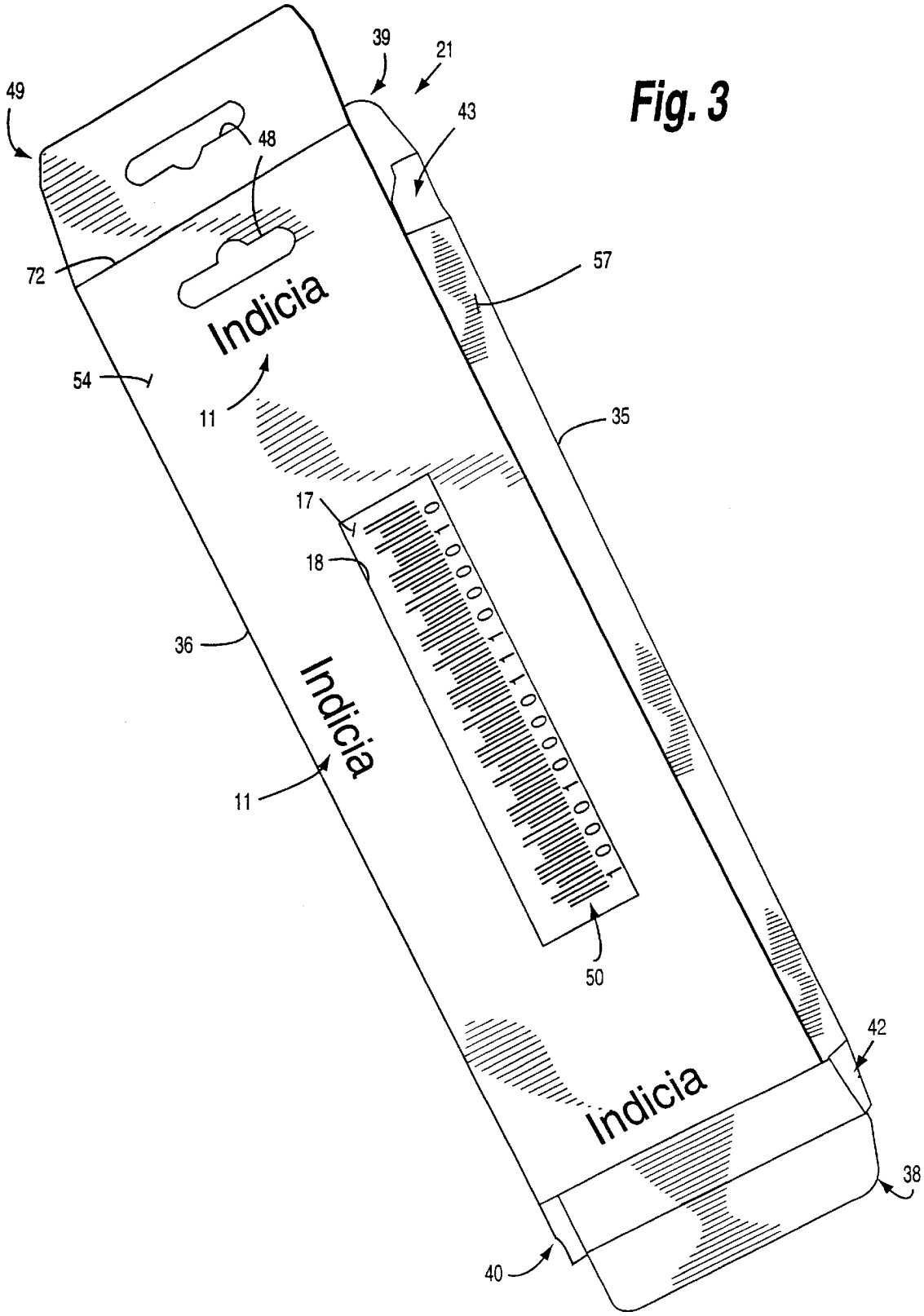
FIG. 3 is a bottom plan view of a substantially flat intermediate package according to the invention, packaging a prepaid phone card having machine readable indicia thereof visible through a cutout in the package.

As schematically illustrated by box 19 in FIG. 1, ultimately (typically after stage 16, although under some circumstances before that stage) the blank 14 is folded over the article 17, and is indicated at 20 in FIG. 1, various parts of the blank 14 are affixed together to produce an intermediate package, shown generally by reference numeral 21 in FIG. 3. The affixing or attachment provided in stage 20 may be utilizing any conventional technique, including stapling, applying adhesive labels or stickers, interlocking tab components together, etc. In the embodiment illustrated, however, this is accomplished by utilizing conventional permanent adhesive such as in the pattern 22 illustrated in FIG. 2, adjacent the free edge 23 of a major portion 24 of the blank 14, the adhesive 22 coming in contact with the opposite face of the support web base portion 25 illustrated in FIG. 2 (that is the surface 26 thereof illustrated in FIG. 2, and also seen in FIG. 5) so as to hold them together. The face 26 of the support web portion 25 also may have permanent adhesive provided thereon substantially over the entire face 26 thereof, as illustrated schematically for the dotted line folded over schematic portion of the section 25 illustrated in FIG. 2.

The substantially flat intermediate package 21 of FIG. 3 is shipped substantially flat, as illustrated schematically at 29 in FIG. 1, to at or near a display location. Then at or near the display location, the intermediate package 21 is expanded—as illustrated schematically at 30 in FIG. 1—so that it has a second interior volume greater than the first interior volume it had in the substantially flat condition of FIG. 3. The first volume, in the substantially flat intermediate package 21 condition, is very small, being little more than the open space provided by the thickness of the article 17 and/or support web portions (such as the portion 25) if provided. However, when expanded the package has the second volume as illustrated for the expanded intermediate package 31 in FIG. 4. The second volume is shown generally by reference numeral 32. The volume 32 is at least three times (and typically ten times or more) the interior volume in the intermediate package configuration 21 of FIG. 3, and preferably the thickness 33 (see FIG. 4) of the package 31 is at least about 0.7 inches (e.g. at least about ¾ of an inch).

The expanding stage 30 may be practiced in a number of different manners. Typically the simplest and preferred manner is for one to grasp the intermediate 21 at the side edges 35, 36 thereof, and to squeeze the edges 35, 36 toward each other using one's fingers or hands. This causes the intermediate package 21 to assume the second volume 32 configuration 31 of FIG. 4.

Figure 4:
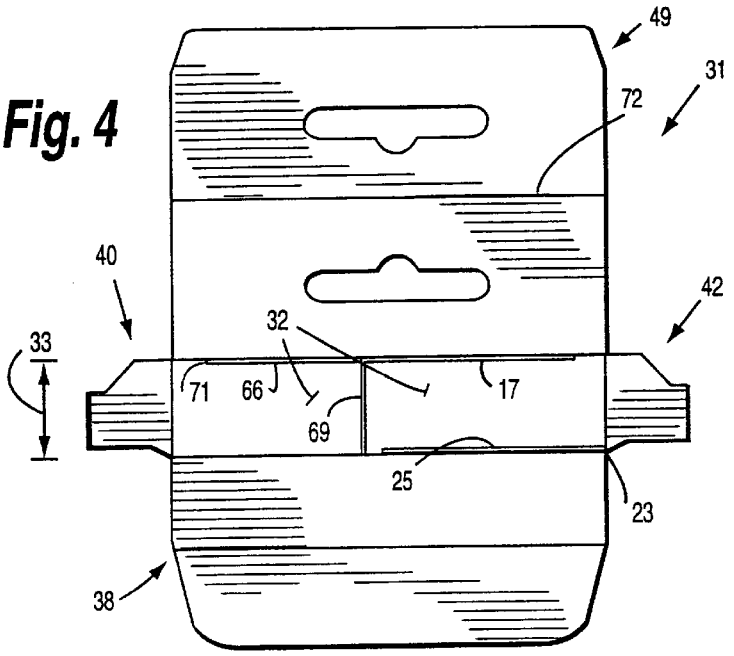
FIG. 4 is an end view of the intermediate package of FIG. 3, looking in on the bottom as seen in FIG. 3, after the intermediate package has been expanded to a display volume configuration.

Once the configuration 31 of FIG. 4 has been obtained, then as indicated schematically by stage 37 in FIG. 1, the package is secured in that condition, typically by folding end flaps, such as the end flaps 38, 39, into the open ends of the package 31, and typically also utilizing the conventional side flaps, such as the side flaps 40, 41, 42, and 43 illustrated in FIGS. 2 through 5. Of course, alternative techniques could be used, such as conventional staples, labels, stickers, or the like.

Figure 5:
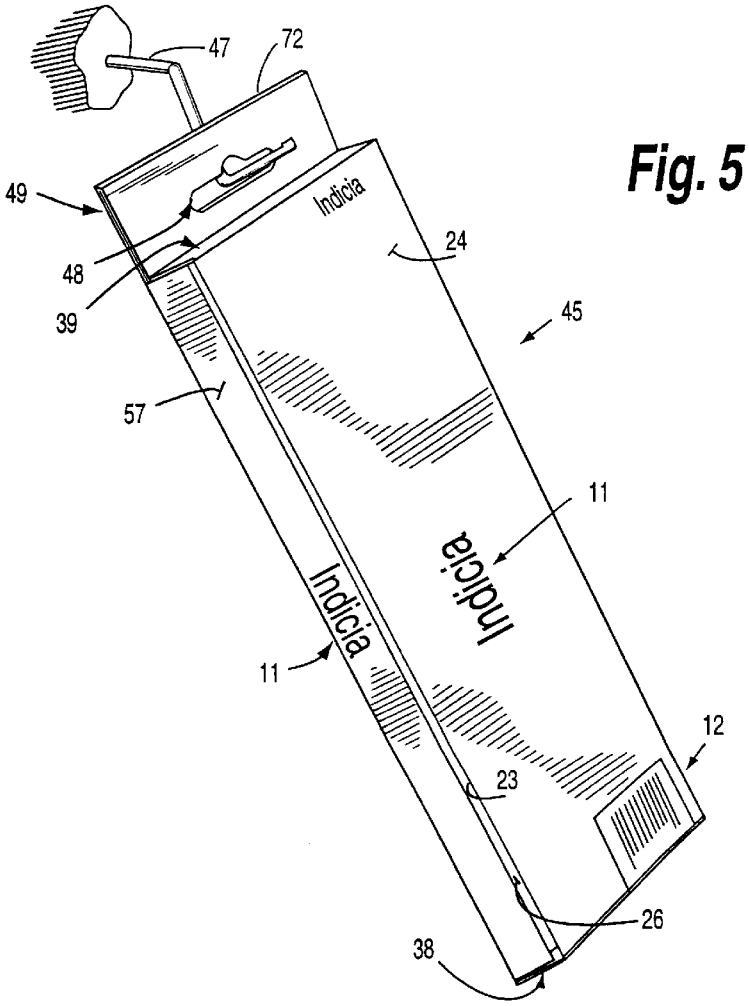
FIG. 5 is a top perspective view of the expanded package of FIG. 4 after flaps have been folded to hold the package in place, and shown displayed on a J-hook.

The final completed package is illustrated schematically at 45 in FIG. 5. The package 45 is displayed, as illustrated schematically at 46 in FIG. 1, and shown in FIG. 5 displayed on a conventional display hook (e.g. J-hook) 47, which passes through one or more display hook-receiving openings 48 formed in one or more flaps 49 of the package 45.

If the article 17 being packaged is—as illustrated schematically in FIGS. 2–4—a prepaid phone card or like debit card, having machine readable activatable indicia 50 (see FIG. 3), then as illustrated schematically at 51 in FIG. 1 the package 45 is placed near an appropriate machine reader so as to read the indicia 50 and activate the card 17. The indicia 50 may be any conventional suitable indicia for this purpose, such as a magnetic strip, bar coding, etc.

The package paperboard blank 14 illustrated in FIG. 2 includes, in addition to the first major portion 24 having a free side edge 23 and a second edge 53, a second major portion 54. The second edge 53 is integral with a first complete package side portion 56, which is also integral with the first edge 36 of the second major portion 54. The edges 36, 53 may be score lines, fold lines, or the like, for convenience. Alternatively they may be perforation lines. Essentially any lines of weakness may be provided which is suitable for a particular purpose.

The second side edge 55 of the second major portion 54 is integral with the second completed package side portion 57. Typically the side portions 55, 57 have the same width, which is substantially equal to the dimension 33 also seen in FIG. 4. Not that the side flaps 40, 41 are integral with, and connected via fold lines 58, 59, with the side portion 55, while the side flaps 42, 43 are integral with, and connected by fold lines 60, 61, respectively to, the side portion 57.

In the embodiment illustrated in FIG. 2, the end flaps 38, 39 are integral with and connected by fold lines 62, 63, respectively, with the first major portion 24, however it is to be understood that one or both of the end flaps 38, 39 may be associated with the second major portion 54. Also the flap 49 containing the one or more J-hook receiving openings 48 also may be associated with the portion 24 instead of or in addition to the portion 54. Further, the opening 15—which is preferably substantially rectangular (although the edges do not need to be completely straight)—is formed in the portion 54, but it may alternatively, or in addition (if more than one card 17 is being packaged), be provided in the portion 24.

While for the blank 14 the edge 35 of the side portion 57 may be a free edge, or a very short side flap for attachment to the adhesive 22 may be provided, preferably a support web, illustrated generally by reference numeral 65 in FIG. 2, is provided to facilitate supporting the package 31, 45 in the completed package position. In the preferred embodiment illustrated in FIG. 2, the support web 65 includes a first base portion 25 and a second base portion 66 separated by and integral with (via fold line 67, 68, respectively) a web support portion 69. The web support portion 69 also typically has substantially the dimension 33, or at least the dimension 33, although it may be slightly shorter. However, when it has the same dimension 33 then the web support 69 assumes the position illustrated in FIG. 4 and provides a central support for the interior of the volume 32, that is for the longitudinal center portions of the sections 24, 54.

In the preferred embodiment the web base 25 is connected by the adhesive 27 to the surface of the major portion 24 illustrated in FIG. 2, while the adhesive 70 on the face of the base portion 66 illustrated in FIG. 2 engages the face of the second major portion 54 illustrated in FIG. 2, and—as illustrated in FIG. 4—also engages the card 17 and assists in holding the card 17 in place. Depending upon the particular adhesive 70, which typically is a pressure sensitive adhesive (as are the adhesives 22 and 27), it need not be provided over the entire face of the web base portion 66 as illustrated in FIG. 2, but rather may only be spot coated thereon and not actually engage the card 17, but merely the second major 54 spaced from the card 17. The web support section 66 has a free end 71 thereof, visible in FIGS. 2 and 4. Triangular or like cutout portions 73 may be provided—as illustrated in FIG. 2—to facilitate folding of the support portion 69 with respect to the base portion 66 of the web 65, about the fold line 68, if desired.

Note that FIG. 2 illustrates the first major face of the blank 14, comprising what is primarily the interior surface (or disposed within the interior) of the final completed package 45, whereas collectively FIGS. 3 and 5 illustrate the second major surface of the blank 14 which provides the majority of the exterior of the final package 45 produced. Note also that the upper and lower portions of the flap 49 may be folded over with respect to each other about the fold line 72 (see FIGS. 2 and 3 in particular) so as to provide a double thickness of material at the display hook 47 so that the package 45 is not easily ripped if pulled on while still engaging the hook 47, and is typically held in place by the end flap 39 and may assist the end flap 39 in closing one of the open ends of the expanded intermediate package 31 of FIG. 4.

While the invention is illustrated as packaging a plastic card 17, such as a prepaid phone card, debit card, or the like, the article 17 may comprise a wide variety of other substantially flat articles, such as substantially flat pharmacy products (such as relatively thin pill packages, or solid strips of medication, etc.), gift certificates, pads of specialty paper (such as litmus paper, lens cleaning paper, filter paper, etc.), inflatable primarily elastomeric elements (such as balloons, bladders, etc.), strips of gum or candy, electronic remote controls (such as those having a of small, thin, card configuration), or printed publications (typically small printed publications).

Figure 6:
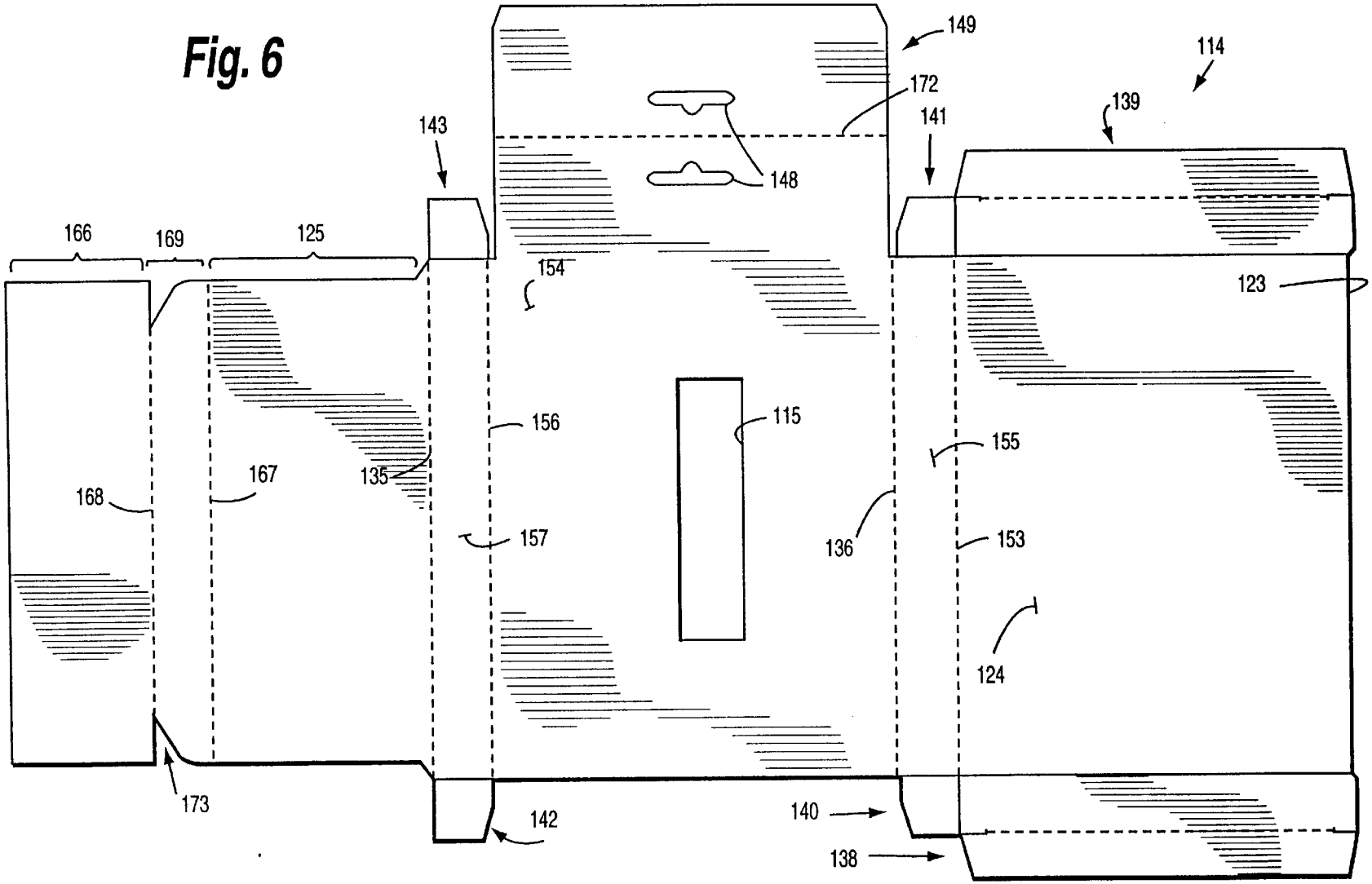
FIG. 6 is a view like that of FIG. 2 only showing a slightly different embodiment of the carton blank according to the present invention.

FIG. 6 illustrates another embodiment of the invention that is very similar to that of FIG. 2 except for the relative dimensions of the components, and a few minor shape distinctions. In FIG. 6 components comparable to those of FIG. 2 are shown by the reference numeral only preceded by a "1".

While the invention has been herein shown and described in what is presently conceived to be the most practical and preferred embodiments thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method of packaging and displaying a relatively flat article, comprising:

(a) cutting a box blank from a sheet or web of paperboard, the blank having first and second major surfaces;

(b) attaching the relatively flat article to the first major surface of the blank;

(c) folding the blank around the relatively flat article, and attaching portions of the blank to each other, to form an intermediate package and so that the first major surface is at least primarily an inner surface of the intermediate package, and so that the second major surface is at least primarily an outer surface of the intermediate package, and so that the intermediate package is also substantially flat, having a first interior volume; then (d) shipping the substantially flat intermediate package to at or near a display location; then (e) at or near the display location, expanding the substantially flat intermediate package so that it has a second interior volume greater than the first interior volume, to form a completed package;

(f) acting on the completed package to maintain it in completed package form; and then (g) displaying the completed package from (f) at the display location.

2. A method as recited in claim 1 wherein the substantially flat article is a prepaid phone card having machine readable activation indicia thereon; and further comprising, prior to (c), cutting an opening in the blank; and wherein (c) is practiced by affixing the phone card to the blank so that the machine readable activation indicia is visible through the opening in the blank so that the phone card can be activated without removing the phone card from the completed package.

3. A method as recited in claim 1 wherein (a)–(e) are practiced so that the second volume is at least three times the first volume, and the completed package is at least about 0.7 inches thick.

4. A method as recited in claim 1 wherein (b) is practiced using removable adhesive acting substantially directly between the article and the blank first surface.

5. A method as recited in claim 1 wherein (c) is practiced in part by affixing portions of the blank first surface to portions of the second surface using permanent adhesive.

6. A method as recited in claim 1 wherein (a) and (c) are practiced so as to provide end closing flaps for the completed package; and wherein (f) is practiced to move the end closing flaps into position so as to close the completed package and maintain the completed package in expanded condition.

7. A method as recited in claim 6 wherein (a) and (c) are further practiced to provide an interior support web moveable between non-supporting and supporting positions; and wherein (f) is further practiced to move the support web to its supporting position.

8. A method as recited in claim 7 wherein (b) and (c) are further practiced so that the support web at least assists in holding the article in position within the intermediate package.

9. A method as recited in claim 1 wherein the intermediate package has opposite closed side edges, and opposite open ends; and wherein (e) is practiced to squeeze the closed side edges toward each other.

10. A method as recited in claim 9 wherein (f) is practiced to close the opposite open ends; and wherein (a)–(g) are practiced using a prepaid phone card, debit card, substantially flat pharmacy product, gift certificate, pad of specialty paper, inflatable primarily elastomeric element, strip gum or candy, electronic remote control, or printed publication, as the article being packaged.

11. A method as recited in claim 1 further comprising (h) printing the blank so that the second surface thereof has indicia thereon; and (i) forming one or more display hook-receiving openings in the blank; and wherein (g) is practiced by passing a display hook through the one or more hook-receiving openings.

12. A method as recited in claim 2 further comprising forming one or more display hook-receiving openings in the blank; and wherein (g) is practiced by passing a display hook through the one or more hook-receiving openings.

13. A method as recited in claim 1 wherein (f) is practiced to close the opposite open ends; and wherein (a)–(g) are practiced using a prepaid phone card, debit card, substantially flat pharmacy product, gift certificate, pad of specialty paper, inflatable primarily elastomeric element, strip gum or candy, electronic remote control, or printed publication, as the article being packaged.

14. A method as recited in claim 3 wherein the intermediate package has opposite closed side edges, and opposite open ends; and wherein (e) is practiced to squeeze the closed side edges toward each other.

15. A method as recited in claim 3 wherein (a) and (c) are practiced so as to provide end closing flaps for the completed package; and wherein (f) is practiced to move the end closing flaps into position so as to close the completed package and maintain the completed package in expanded condition.

16. A method as recited in claim 15 wherein (b) and (c) are further practiced so that the support web at least assists in holding the article in position within the intermediate package.

17. A method as recited in claim 6 wherein (c) is practiced in part by affixing portions of the blank first surface to portions of the second surface using permanent adhesive.

18. A method as recited in claim 8 wherein (c) is practiced in part by affixing portions of the blank first surface to portions of the second surface using permanent adhesive.

* * * * *